US005466177A

United States Patent [19]

Aihara et al.

[11] Patent Number: 5,466,177

[45] Date of Patent: Nov. 14, 1995

[54] VARIABLE PROPELLER FOR BOAT

[75] Inventors: Takao Aihara; Taro Fukuda; Hideaki Takada, all of Wako, Japan

[73] Assignee: Honda Giken Kogyo Kabushiki Kaisha, Tokyo, Japan

[21] Appl. No.: 364,203

[22] Filed: Dec. 27, 1994

[30] Foreign Application Priority Data

Dec. 27, 1993 [JP] Japan ..... 5-331600

[51] Int. Cl.[6] ..... B63H 3/00

[52] U.S. Cl. ..... 440/50; 440/49; 416/89

[58] Field of Search ..... 440/49, 50; 416/87–89, 416/131, 135, 143

[56] References Cited

U.S. PATENT DOCUMENTS

D. 141,235 5/1945 Birsch ..... 416/89
3,565,544 2/1971 Marshall ..... 416/89
4,801,243 1/1989 Norton ..... 416/89

FOREIGN PATENT DOCUMENTS 21307 8/1920 France ..... 416/89
2-144287 6/1990 Japan .

*Primary Examiner*—Jesus D. Sotelo
*Attorney, Agent, or Firm*—Nikaido, Marmelstein, Murray & Oram

[57] ABSTRACT

A sleeve 18 spline-fitted in an outer periphery of a propeller shaft 4 is connected to a propeller boss 12 for surrounding the outer periphery of the sleeve by a damper rubber 20 interposed in superposed relation therebetween, and in a recess formed in the outer periphery of the propeller boss 12 so that a bottom surface thereof comes near the outer periphery of the damper rubber 20, propeller blades are rotatably supported on a blade shaft 33 parallel to the propeller shaft 4. With this arrangement, it is possible to provide a compact variable propeller for a boat which can be mounted on a relatively short propeller shaft and which is provided with a torque limiting device.

3 Claims, 12 Drawing Sheets

VARIABLE PROPELLER FOR BOAT

BACKGROUND OF THE INVENTION

1. Field of the Invention

The present invention relates to a variable propeller for a boat, in which a propeller shaft supported in a body of a propelling device to project rearwardly of the body is connected with a propeller boss disposed rotatably about the propeller shaft through a torque limiting device which produces a slip, if it receives a torque equal to or more than a predetermined value, and a plurality of propeller blades are mounted to the propeller such that the propeller blades can be displaced.

2. Description of the Prior Art

Such variable propeller includes propeller blades and a torque limiting device arranged axially, as disclosed, for example, in Japanese Patent Application Laid-Open No. 144287/90. Hence, the axial length of the variable propeller is longer as compared with that of a usual propeller having stationary blades, Thereupon, when the usual propeller is replaced by the variable propeller, in the past, the propeller shaft carried in the body of the propelling device is replaced by a long propeller shaft exclusively used for the variable propeller. However, such a replacing operation is very troublesome, because of an attendant disassembling of the body of the propelling device.

Accordingly, it is an object of the present invention to provide the variable propeller for a boat which can be easily mounted to a relatively short propeller shaft for a usual propeller.

SUMMARY OF THE INVENTION

To achieve the above object, according to a first feature of the present invention, there is provided an arrangement wherein the torque limiting device and the propeller boss are disposed in concentrically superposed relation about the propeller shaft, the propeller boss is provided with a plurality of recesses whose bottom surfaces are arranged circumferentially in proximity to the torque limiting device, and a boss for each of the propeller blades is rotatably supported, in the recesses, by a blade shaft carried by both front and rear end walls of the recesses in parallel to the propeller shaft such that a propeller diameter is variable.

According to the above first feature, since a torque limiting device and a propeller boss are arranged in oncentrically superposed relation, the propeller boss can be constructed compactly and can be also mounted to a relatively short propeller shaft which has been mounted to a usual propeller. Further, the boss for the propeller blades supported by the blade shaft in the recess in the outer peripheral surface of the propeller boss is to be located in proximity of the outer periphery of the torque limiting device, which enables the mounting of a plurality of variable-diameter propeller blades while suppressing a larger- diameter of the propeller boss to the utmost. Moreover, since the blade shaft is supported at opposite ends thereof by both front and rear end walls of the recess, the blade shaft is rigidly supported and can positively support the rotating propeller blades.

According to a second feature of the present invention, in addition to the above first feature, the propeller boss is provided with an exhaust passage which axially extend through a land portion between the plurality of recesses to open an exhaust outlet of the body of the propelling device into a rear end of the propeller boss.

According to the above second feature, a plurality of exhaust passages can be easily formed in the propeller boss without being obstructed by the propeller blades and the blade shafts, to enable the exhaust from the propeller boss.

Further, according to a third feature of the present invention, in addition to the above first and second features, the plurality of blade shafts connected to the plurality of propeller blades through a synchronizer so as to be rotated along with the propeller blades, the synchronizer comprising cranks continuously formed to one end of each of the blade shafts such that a tip end of a crank arm is directed at the propeller shaft, and a synchronizing ring engaged with crank pins of all the cranks and capable of being rotated around the propeller shaft, the synchronizer being accommodated in a synchronizer chamber formed at one end of the propeller boss.

According to the above third feature, all propeller blades can he rotated by the synchronizer synchronously despite the difference between individuals to always obtain the stabilized propeller performance. Furthermore, since the synchronizer is compact, it can be easily accommodated in a narrow synchronizing chamber of the propeller boss, and the synchronizer can be protected from an obstacle.

The above and other objects, features and advantages of the invention will become apparent from the following description of preferred embodiments taken in conjunction with the accompanying drawings.

BRIEF DESCRIPTION OF THE DRAWINGS

FIGS. 1 to 7 illustrate a first embodiment of the present invention, wherein FIG. 1 is a partially vertical sectional view of an essential portion of a propelling device for a boat provided with a variable propeller;

FIG. 2 is an enlarged vertical sectional view of a propeller portion;

FIG. 3 is a sectional view taken along a line 3—3 in FIG. 2;

FIG. 4 is a sectional view taken along a line 4—4 in FIG. 2;

FIG. 5 is a sectional view similar to FIG. 4 with some parts removed;

FIG. 6 is a view taken along an arrow 6 in FIG. 2; and

FIG. 7 is an exploded perspective view of an essential portion of the propeller;

FIGS. 9 and 10 illustrate a third embodiment of the present invention; wherein FIG. 9 is a vertical sectional view of a propeller portion; and FIG. 10 is an exploded perspective view of an essential portion of the propeller; and FIGS. 11 to 13 illustrate a fourth embodiment of the present invention; wherein FIG. 11 is a vertical sectional view of a propeller portion;

FIG. 12 is a sectional view taken along a line 12—12 in FIG. 11; and FIG. 13 is a plan view of a single synchronizing ring.

DESCRIPTION OF THE PREFERRED EMBODIMENTS

The present invention will now be described by way of preferred embodiments in connection with the accompanying drawings.

Figure 1:
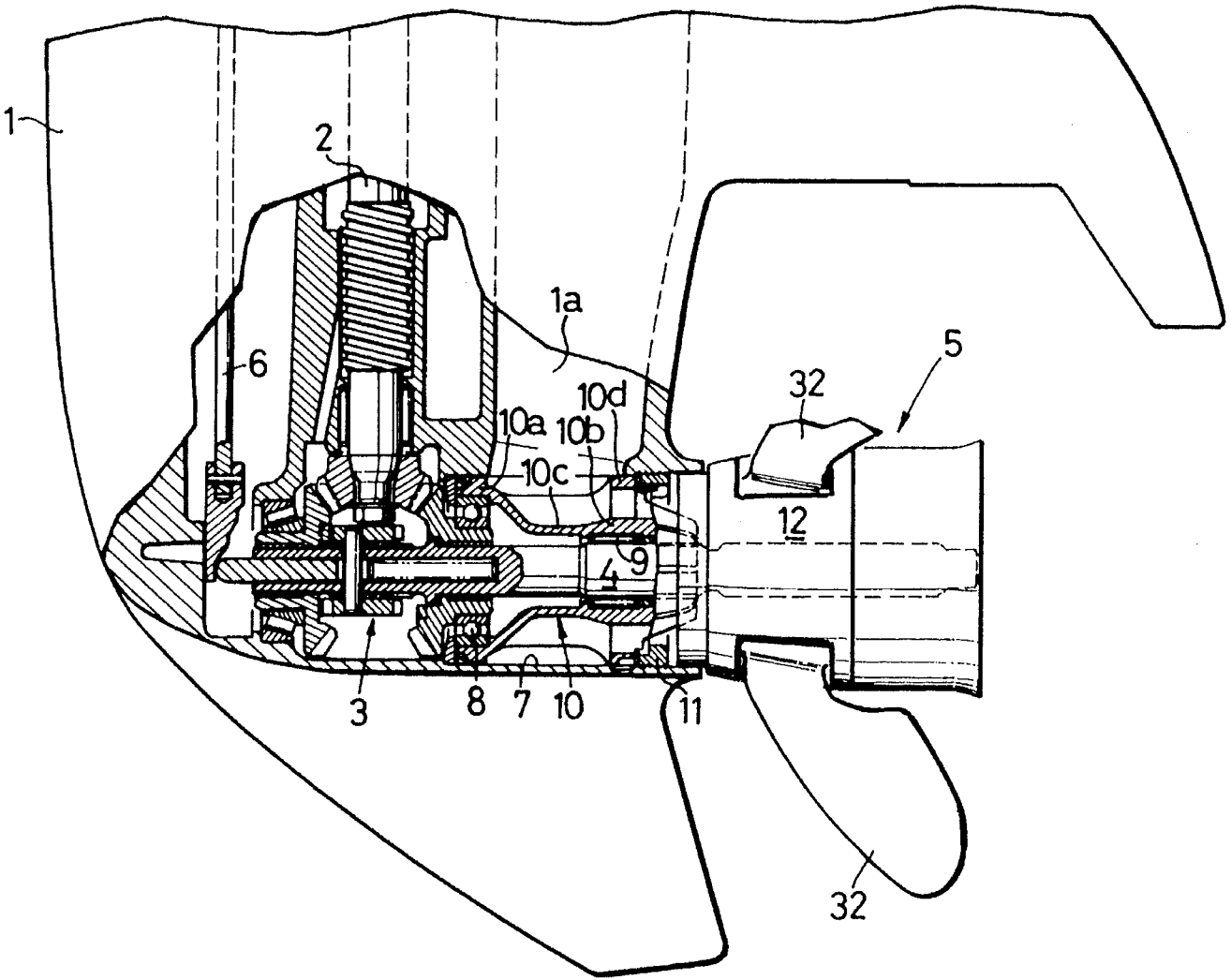

A first embodiment shown in FIGS. 1 to 7 will be first described. Referring to FIG. 1, carried on a body of a propelling device 1 of an outboard motor mounted on transom of a ship or boat are a vertically-disposed driving shaft 2 driven from an engine which is not shown, and a horizontally-disposed propeller shaft 4 connected to the driving shaft 2 through a gear mechanism 3. A variable-diameter type propeller 5 is mounted on a portion of the propeller shaft 4 projected rearwardly from the body of the propelling device 1.

The gear mechanism 3 is of a known bevel gear type and is switchable between a forward mode capable of driving the propeller shaft 4 in a forward direction and backward mode capable of driving the propeller shaft 4 in a backward direction.

Figure 2:
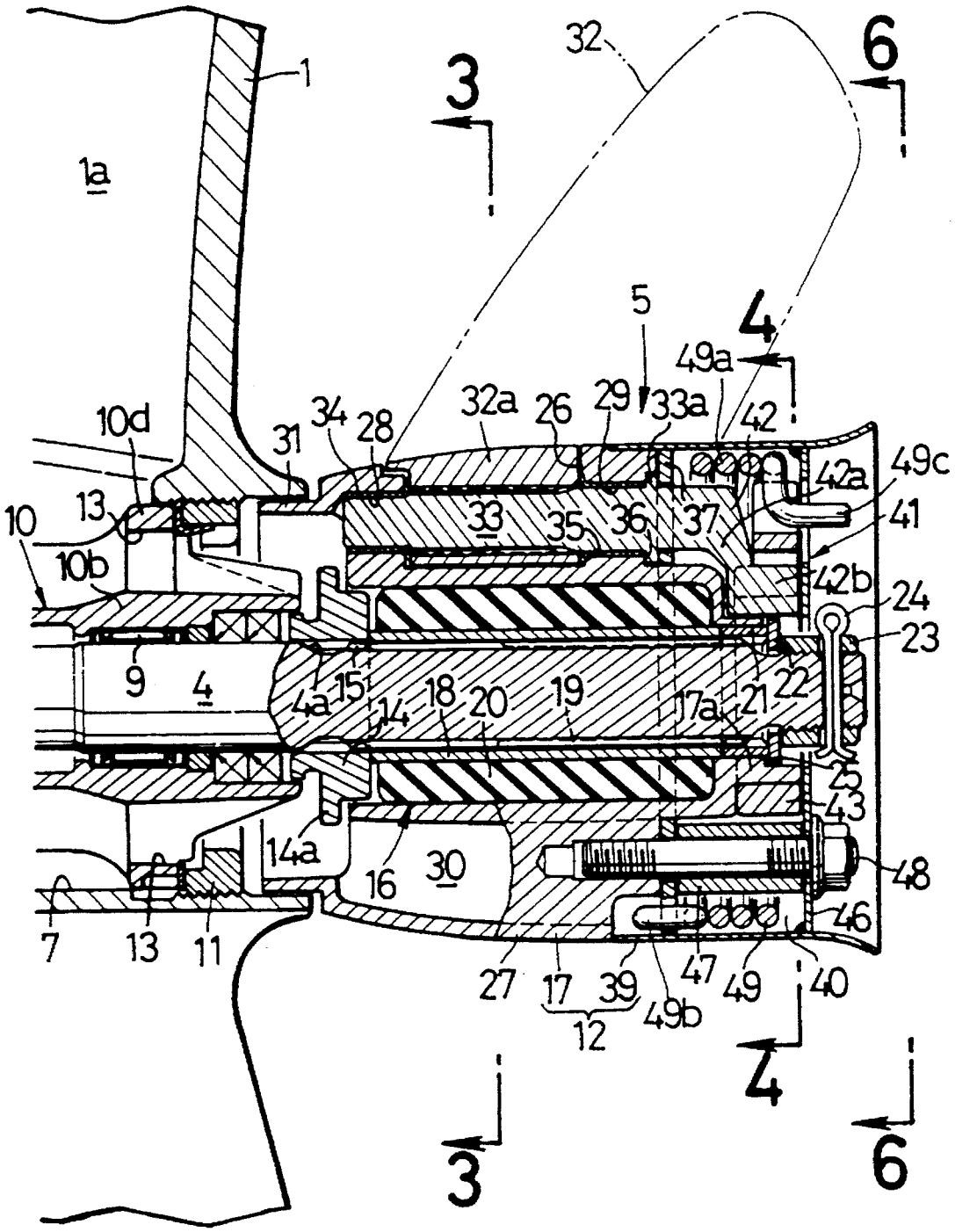

Referring to FIGS. 1 and 2, a bearing holder 10 for holding a pair of front and rear bearings 8 and 9 used for carrying the propeller shaft 4 is fitted in a mounting hole 7 opened in a rear surface of the body of the propelling device 1. A ring nut 11 is also threadedly fitted in the mounting hole 7 for pressing the bearing holder 10 from rearward. The bearing holder 10 includes a larger-diameter sleeve portion 10*a* for holding the front ball bearing 8, and a smaller-diameter sleeve portion 10*b* for holding the rear needle bearing 9. Both the sleeve portions 10*a* and 10*b* are integrally connected to each other through a tapered sleeve portion 10*c*. A flange 10*d* is integrally formed on the smaller-diameter portion 10*b* to project from an outer peripheral surface thereof and retained by the ring nut 11. A plurality of exhaust outlets 13 are provided in the flange 10*d* to communicate with an exhaust port of the engine through a hollow portion 1*a* in the body of the propelling device 1.

The construction of the variable-diameter type propeller 5 will be described in connection with FIGS. 2 to 7.

Referring to FIG. 2, a thrust ring 14 is fitted through a spline 15 over the propeller shaft 4 adjacent a rear end of the bearing holder 10. The thrust ring 14 is prevented from being moved forwardly by abutting against a tapered surface 4*a* of the propeller shaft 4.

In the rear of the thrust ring 14, a boss body 17 of a propeller boss 12 is connected to the propeller shaft 4 through a torque limiting device 16. The torque limiting device 16 and the boss body 17 are disposed in a concentrically superposed relation about the propeller shaft 4.

The torque limiting device 16 includes a sleeve 18 detachably fitted over the propeller shaft 4 through a spline 19, and a damper rubber 20 baked on an outer peripheral surface of the sleeve 18 press-fitted to an inner peripheral surface of the boss body 17. The damper rubber 20 is connected to the boss body 17 with a predetermined frictional force, so that if a rotational torque equal to or more than a predetermined value is received, a slipping is produced between the damper rubber 20 and the boss body 17.

An extension collar 21 is spline-fitted over the propeller shaft 4 to abut against a rear end of the sleeve 18. A nut 23 is threadedly fitted over a rear end of the propeller shaft 4 for retaining a rear end of the extension collar 21 through a thrust washer having a diameter larger than that of the extension collar 21. An anti-loosing cotter pin 24 is inserted into the nut 23 and the propeller shaft 4. The extension collar 21 and the sleeve 18 may be formed integrally with each other.

The boss body 17 includes a positioning boss 17*a* projecting rearwardly from an end face covering a rear end of the damper rubber 20 and rotatably fitted over the extension collar 21, whereby the concentric position of the boss body 17 relative to the propeller shaft 4 is maintained. The positioning boss 17*a* is formed into a cylindrical shape to surround the thrust washer 22. The boss 17*a* is provided at its inner peripheral surface with a shoulder 25 which is opposed to a front surface of the thrust washer 22. A rearward thrust applied to the boss body 17 is received by the thrust washer 22 through the shoulder 25. In this case, a flange may be formed around an outer periphery of a rear end of the extension collar 21 and may be put into abutment against the shoulder 25.

A front end face of the boss body 17 is opposed to a flange 14*a* formed around the outer periphery of the thrust ring 14, so that a forward thrust applied to the boss body 17 is received by the flange 14*a*.

Figure 3:
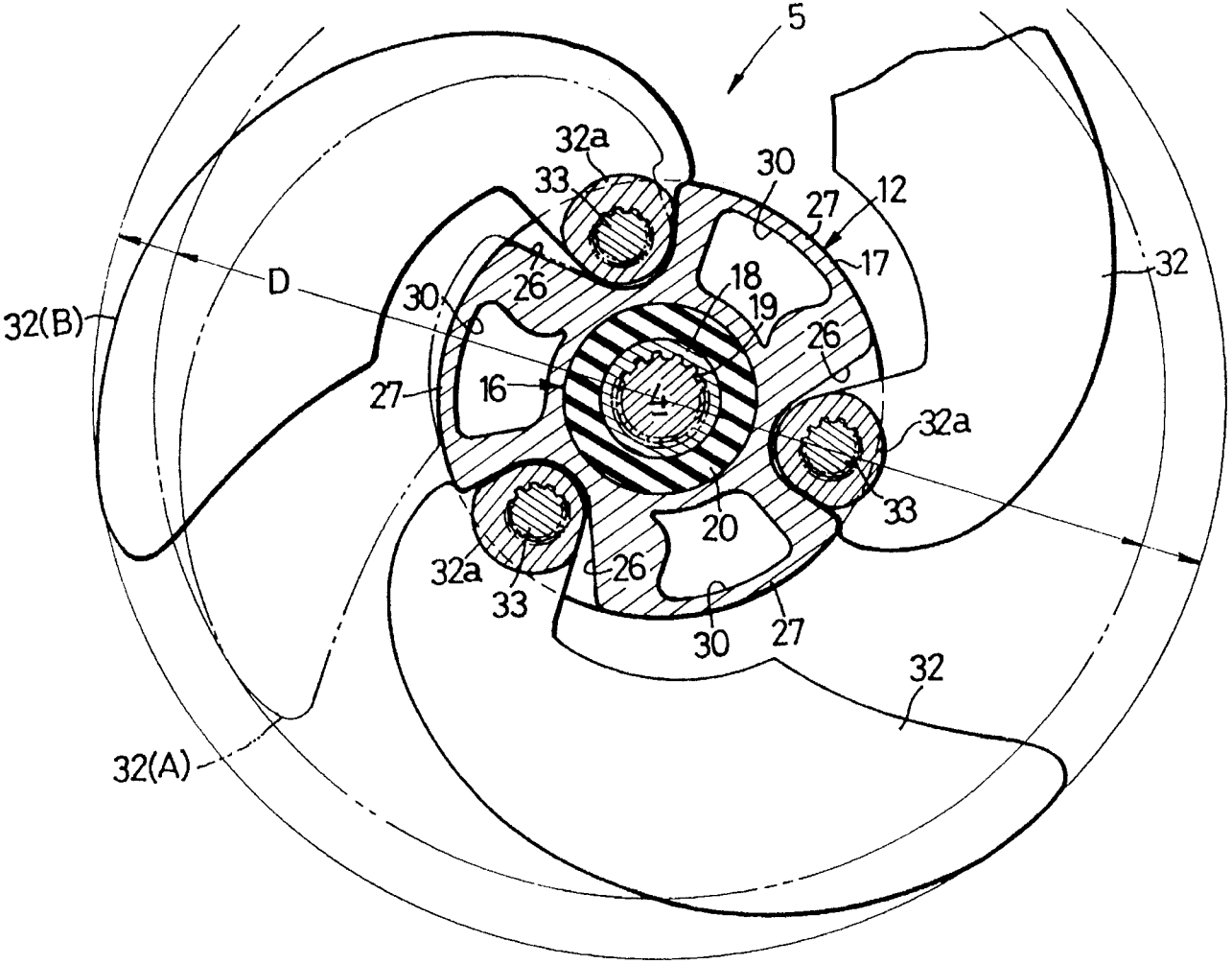
Figure 4:
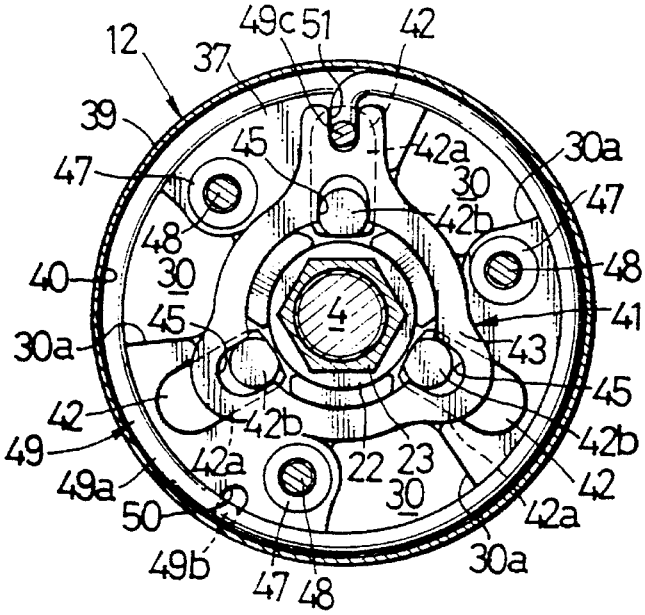
Figure 5:
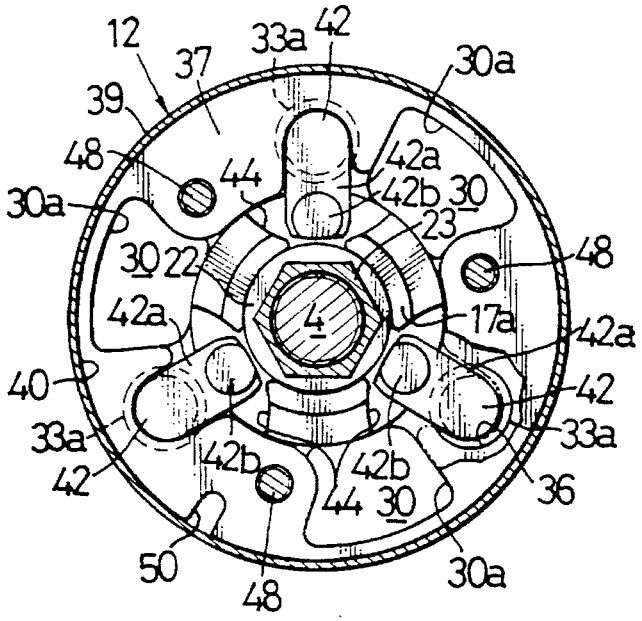

Referring to FIGS. 2 and 3, provided in the boss body 17 are three recesses 26 opened at an outer peripheral surface of the boss body 17 and arranged circumferentially at equal distances with its bottom surface located in proximity to an outer peripheral surface of the damper rubber 20, a pair of bearing holes 28 and 29 opened at longitudinally opposite end walls of each of the recesses 26, three exhaust passages 30 each extending axially through a land portion 27 sandwiched between the adjacent recesses 26, and cylindrical recess 31 permitting the communication between the exhaust passages 30 and the exhaust outlet 13. The cylindrical recess 31 is rotatably inserted in a rear opening of the mounting hole 7.

The boss 32*a* of a propeller blade 32 is accommodated in each of the recesses 26 in the boss body 17. A blade shaft 33 spline-fitted over the boss 32*a* are rotatably carried at longitudinally opposite ends of the shaft 33 in the bearing holes 28 and 29 with bushes 34 and 35 of a synthetic resin interposed therebetween, respectively. In this manner, the three blade shafts 33 are disposed in parallel to the propeller shaft 4 to surround the latter.

Each of the blade shafts 33 is provided with a flange 33*a* which is rotatably accommodated in the circular recess 36 defined in the rear opening of the rear bearing hole 29. A retaining plate 37 common for the blade shafts 33 for retaining the flanges 33*a* from the rearward to fix the axial positions of the blade shafts is secured to a rear end face of the propeller boss 12 by a bolt 48 which will be described hereinafter. The retaining plate 37 is provided with an exhaust passage 30*a* aligned with the exhaust passages 30.

Each of the propeller blades 32 is rotatable along with the blade shaft 33 between a closed position A to provide a minimum diameter D of the propeller and an opened position B to provide a maximum diameter D of the propeller. The closed and opened positioned A and B are limited by abutment of the propeller blade 32 against and inner wall of the recess 26.

Figure 6:
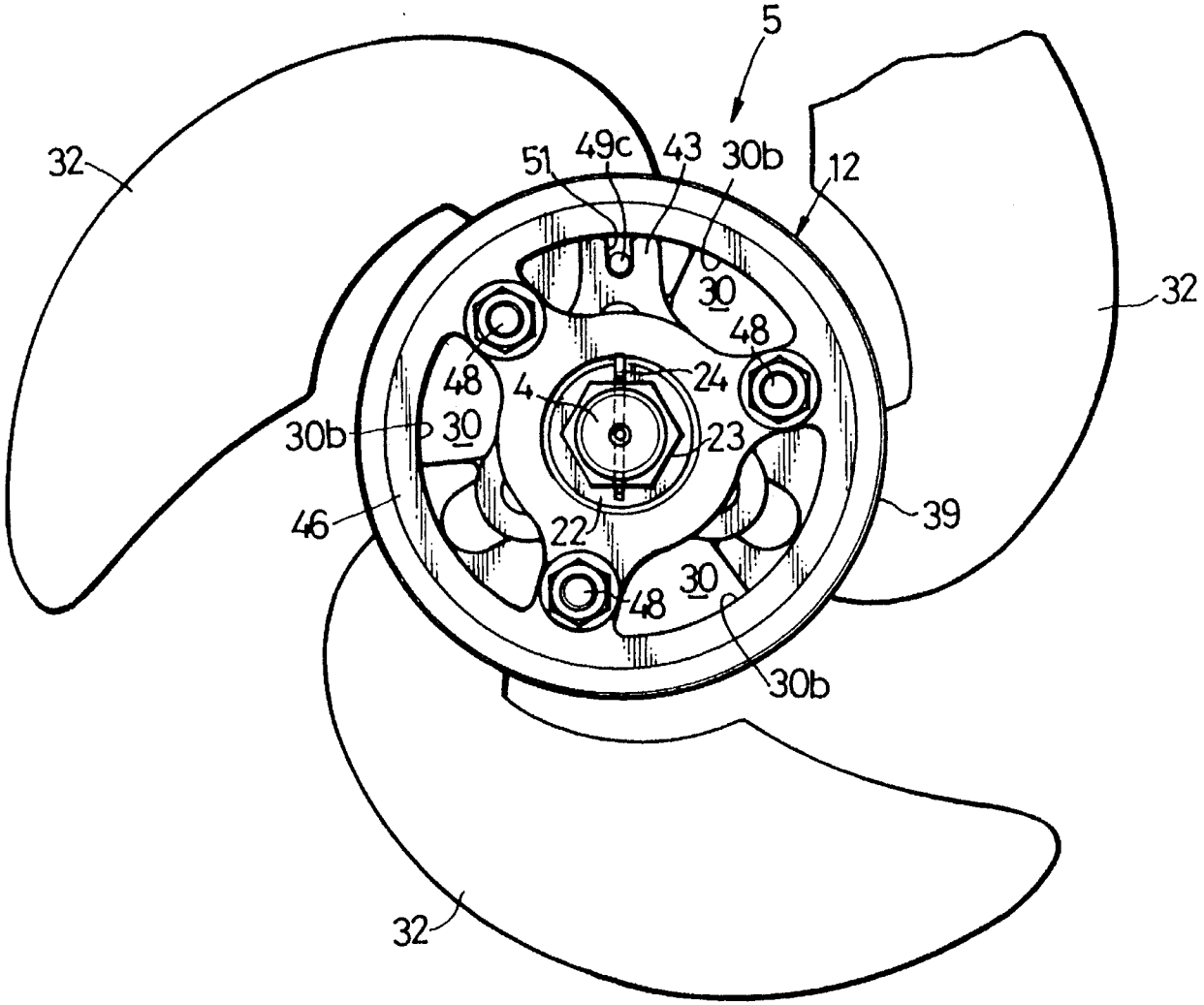
Figure 7:
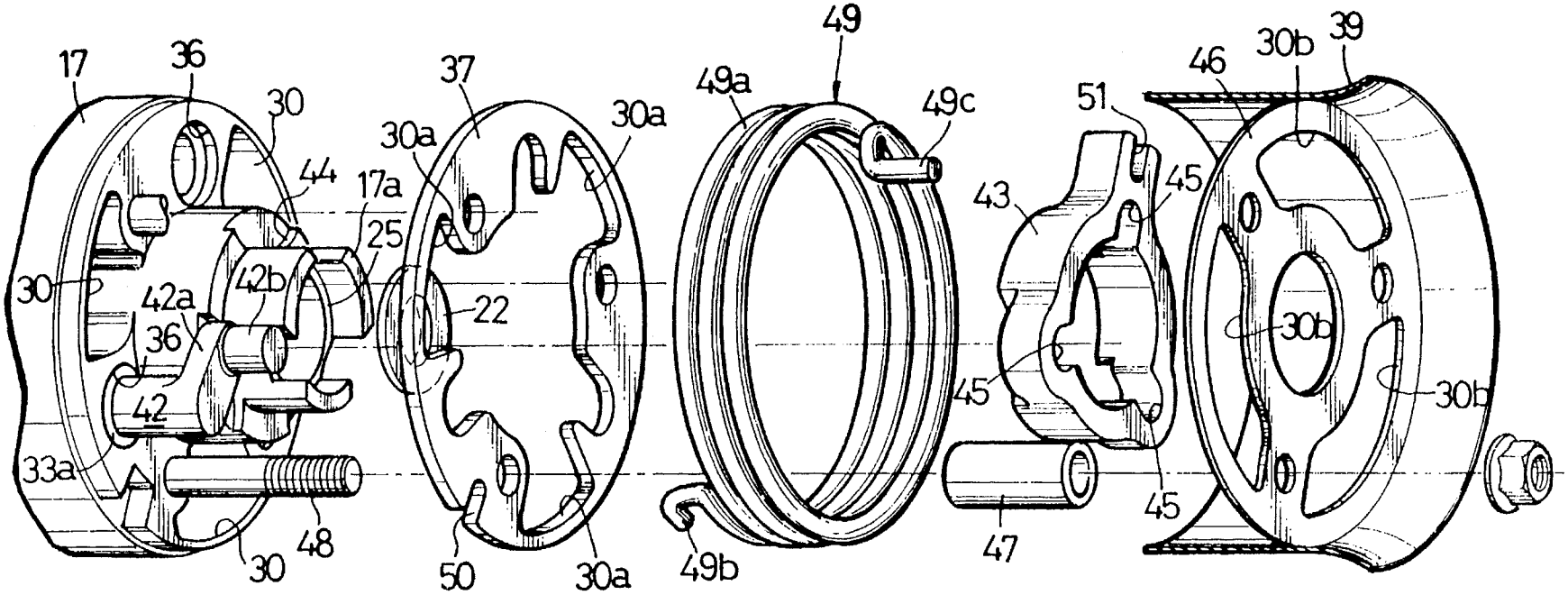

As shown in FIGS. 2, 6 and 7, the propeller boss 12 is constructed by fitting a diffuser pipe 39 of a small wall thickness to the rear end of the boss body 17 in such a manner that outer peripheral surfaces of both the pipe 39 and boss body 17 are continuous to each other. A mounting plate 46 is welded to an inner peripheral wall of the diffuser pipe 39 and secured to the rear end face of the boss body 17 by a bolt 48 in a manner to sandwich a distance collar 47 and the retaining plate 37. The mounting plate 46 is provided with exhaust holes 30*b* at locations corresponding to the exhaust passages 30. The mounting plate 46 is disposed to define a synchronizer chamber 40 between the mounting plate 46 itself and the rear end face of the boss body 17. A synchronizer 41 is formed in the synchronizer chamber 40 for synchronously interlocking all the propeller blades 32 with one another.

More specifically, as shown in FIGS. 2, 4, 5 and 7, the synchronizer 41 includes cranks 42 integrally and continuously formed to the rear ends of the blade shafts 33, and a single synchronizing ring 43 rotatably carried around the outer periphery of the positioning boss 17*a*. A rear surface of the ring 43 is retained by the mounting plate 46 of the diffuser pipe 39, so that it is prevented from being removed from the positioning boss 17*a*.

The crank 42 has a crank arm 42*a* bent from the blade shaft 33 toward the propeller shaft 4, and a crank pin 42*b* is provided at a tip end of the crank arm 42*a* and swingably received in a circular cutout 44 made around the outer periphery of the positioning boss 17*a*. The synchronizing ring 143 is provided with three U-shaped engages 45 opened at its inner peripheral surface, and the crank pins 42*b* are slidably received in the engage grooves 145, respectively. The synchronizing ring 43 is formed into a substantially triangular contour, so that it does not cover the three exhaust passages 30 from the rearward. Thus, all the blade shafts 33 can be rotated synchronously by limiting the rotational angles with one another through the respective corresponding cranks 42 and the common synchronizing ring 43.

A return spring 49 is contained in the synchronizer chamber 40 for biasing all the propeller blades 32 for rotation toward the closed positions A via the synchronizer 41. The return spring 49 includes a torsion coiled spring and has a coiled portion 49*a* which is disposed along the inner peripheral surface of the diffuser pipe 39 to surround all the cranks 42. Locking claws 49*b* and 49*c* are formed at front and rear opposite ends of the coiled portion 49*a* and engaged in engage grooves 50 and 51 formed in the retaining plate 37 and the synchronizing ring 43, respectively.

The operation of this embodiment will be described below. If the propeller shaft 4 is driven from the driving shaft 2 through the gear mechanism 3, the driving torque thereof is transmitted through the sleeve 18 and the damper rubber 20 to the propeller boss 12, and further from the blade shafts 33 to the propeller blades 32. Therefore, the propeller blades 32 are rotated along with the propeller boss 12 to generate a thrust.

In the low speed rotational region of the propeller boss 12, all the propeller blades 32 are retailed at the closed position A through the synchronizer 41 by the force of the return spring 49 to minimize the propeller diameter D. Therefore, the thrust generated is relatively small, and the trawling can be easily effected.

Thereafter, as the rotational speed of the propeller boss 12 increases beyond a given value, all the propeller blades 32 open till the centrifugal force acting thereto is balanced with the drag of water and the repulsion force of the return spring 49. When the rotational speed of the propeller boss 12 enters a predetermined high speed rotational region, all the propeller blades 32 reach the maximum opened position B to maximize the propeller diameter D. Therefore, a great thrust is generated to enable high-speed cruising.

Since all the propeller blades 32 are interlocked with one another by the synchronizer 41 as mentioned previously, unevenness of the opened angle caused by the difference in the centrifugal force acting on each of the propeller blades 32, the drag of water and other external causes can be eliminated to always stabilize the performance of the propeller 5.

When small obstacles such as floating things strike on the propeller blades 32 during cruising, the force of shock is dispersed to all the propeller blades 32 through the synchronizer 41 so that a torsional deformation is generated in the damper rubber 20 to reduce the force of shock applied to the propeller blades 32. Further, when a large obstacle such as a rock strikes on the propeller blades 32, a slipping is produced between the damper rubber 20 and the boss body 17*a*. In such a case, the propeller shaft 4 runs idle relative to the propeller boss 12 so that overloads of various parts of the propeller 5 and of the power transmission system can be shut out.

An exhaust gas from the engine (not shown) is discharged to the hollow 1*a* of the body of the propelling device 1. The exhaust gas is discharged through the exhaust outlet 13 of the bearing holder 10 into the cylindrical portion 31 of the boss body 17, and diverted therefrom into the three exhaust passages 30 and then, sequentially through the exhaust hole 30*a* in the retaining plate 37, the synchronizer chamber 40, and the exhaust passage 30*b* in the mounting plate 46, i.e., through the diffuser pipe 39 into the water. As described above, the delivery of the exhaust gas from the body of the propelling device 1 to the three exhaust passages 30 of the boss body 17 is carried out within the cylindrical portion 31 at the front end of the boss body 17. Therefore, the exhaust gas to the three exhaust passages 30 can be equally distributed.

Furthermore, each of the exhaust passages 30 is formed so as to pass the land portion 27 of the boss body 17, i.e., between the three recesses 26 for accommodating the boss 32*a* of the propeller blades 32. Therefore, it is possible to secure a necessary and sufficient sectional area without being obstructed by the boss 32*a* and the blade shaft 33 for supporting thereof and without being accompanied by an increase in diameter of the propeller boss 12, thus contributing to the reduction in exhaust resistance as well as the equal distribution of the exhaust gas.

On the other hand, the blade shaft 33 can be supported at both ends thereof by a pair of front and rear bearing holes 28 and 29 without being obstructed by the exhaust passages 30 to firmly support the propeller blades 32.

Since the damper rubber 20 of the torque limiting device 16 is disposed in the concentrically superposed relation to the boss body 17, the boss body 17 can be formed into an axial length substantially equal to that of a usual propeller having stationary blades. Therefore, it is possible to attach the boss body 17 to a relatively short propeller shaft to which the usual propeller has been conventionally attached. Moreover, since the propeller blade 32 is formed into a variable-diameter type with its boss 32*a* accommodated in the recess 26 in the outer peripheral surface of the boss body 17 and supported by the blade shaft 33 parallel to the propeller shaft 4, it is possible to inhibit an increase in diameter of the boss body 17 to the utmost, while sufficiently insuring the capacity of the torque limiting device.

In the synchronizer 41, the crank arm 42*a* is bent from the rear end of the blade shaft 33 toward the propeller shaft 4, and the crank pin 42*b* is received in the cutout 44 provided around the outer periphery of the positioning boss 17 and is further engaged by the synchronizing ring 43, as described above. Therefore, it is possible to achieve a reduction in diameter of the synchronizing ring 43 and a compactness of the entire synchronizer 41, and to easily accommodate the synchronizer 41 in the narrow synchronizer chamber 40 within the diffuser pipe 39.

Further, since the common return spring 49 for biasing the synchronizing ring 43 in a direction to close all the propeller blades 32 while surrounding the crank arm 42*b* is contained in the synchronizer chamber 40, the single return spring 49 need only be required for all the propeller blades 32 and moreover, the return spring 49 is protected against an obstacle, along with the synchronizer 41.

Figure 8:
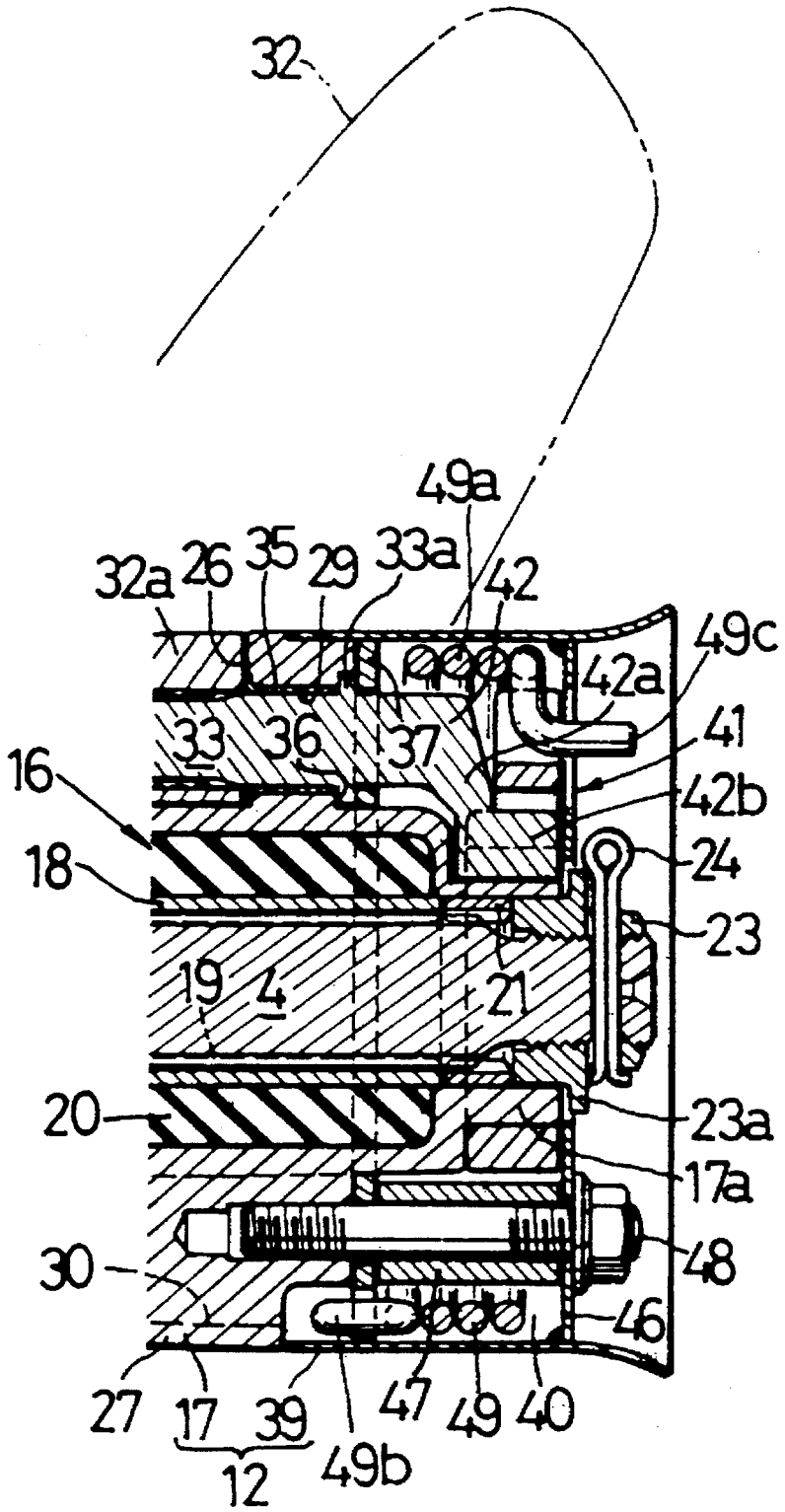
FIG. 8 illustrates a second embodiment of the present invention, which is a vertical sectional view of an essential portion of the propeller.

FIG. 8 illustrates a second embodiment of the present invention. In place of the thrust washer 22 in the previous embodiment, there is formed a flange 23*a* on a nut 23 for fixing a sleeve 18 and an extension collar 21 to a propeller shaft 4 so that a rearward thrust applied to a boss body 17 is received by the flange 23*a*. Other constructions are substantially the same as those of the previous embodiment. In the drawing, therefore, the parts corresponding to those of the previous embodiment are indicated by the same reference numerals as those of the previous embodiment.

Figure 9:
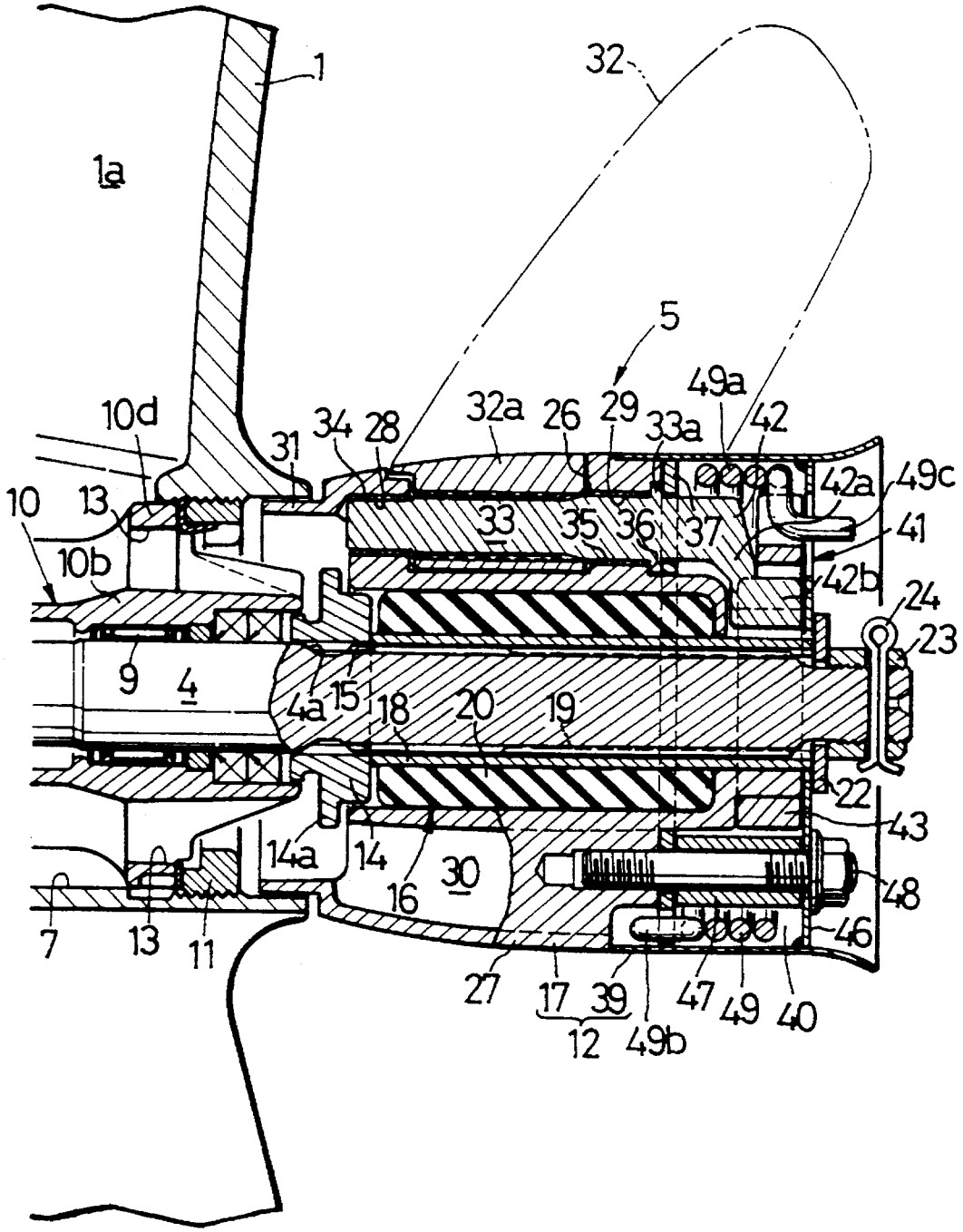
Figure 10:
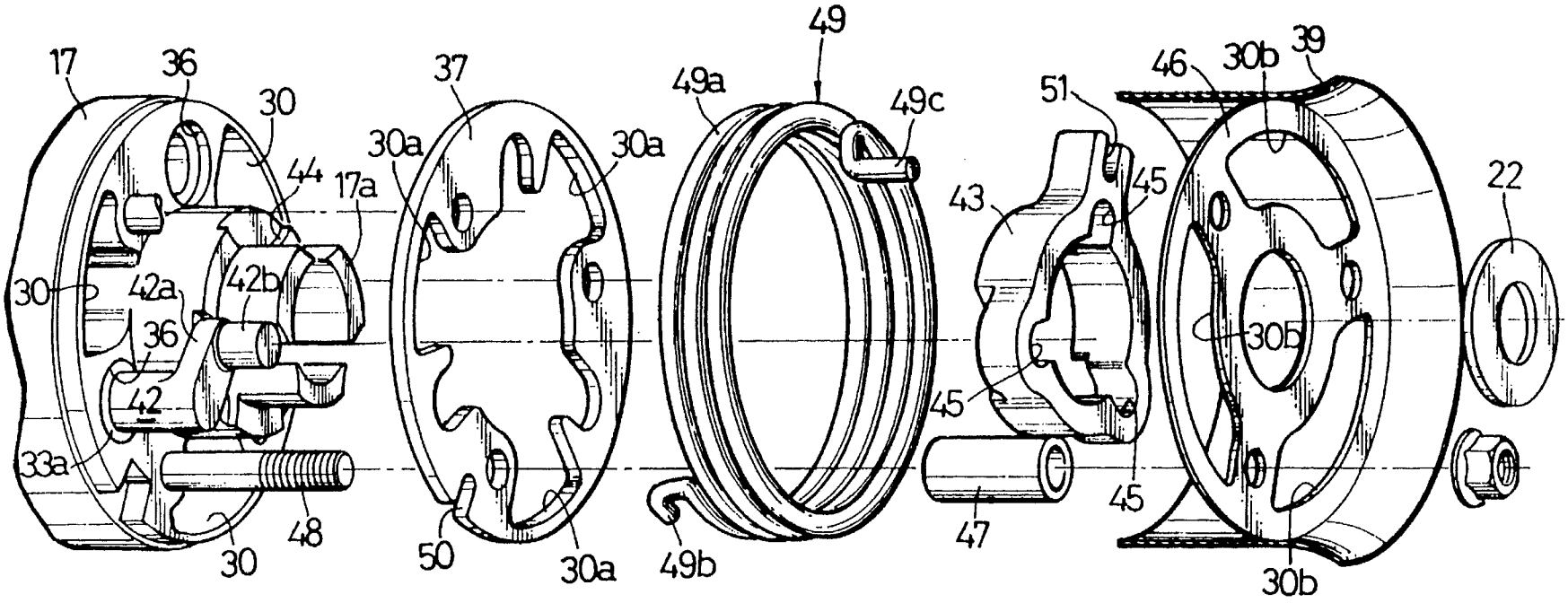

FIGS. 9 and 10 illustrate a third embodiment. For removing the extension collar 21 in the previous embodiment, the rear end of the sleeve 18 is extended so as to abut with the front surface of the thrust washer 22. The rear end of the positioning boss 17*a* of the boss body 17 is carried on the thrust washer 22 through the mounting plate 46 of the diffuser pipe 39. Further, a circular cutout 44 for receiving the crank pin 42*b* of the synchronizer 41 is formed so as to reach the inner peripheral side of the positioning boss 17*a* to make the synchronizer 41 further compact. Other constructions are the same as those of the first embodiment. In the drawing, therefore, the parts corresponding to those of the first embodiment are indicated by the same reference numerals as those of the first embodiment.

Figure 11:
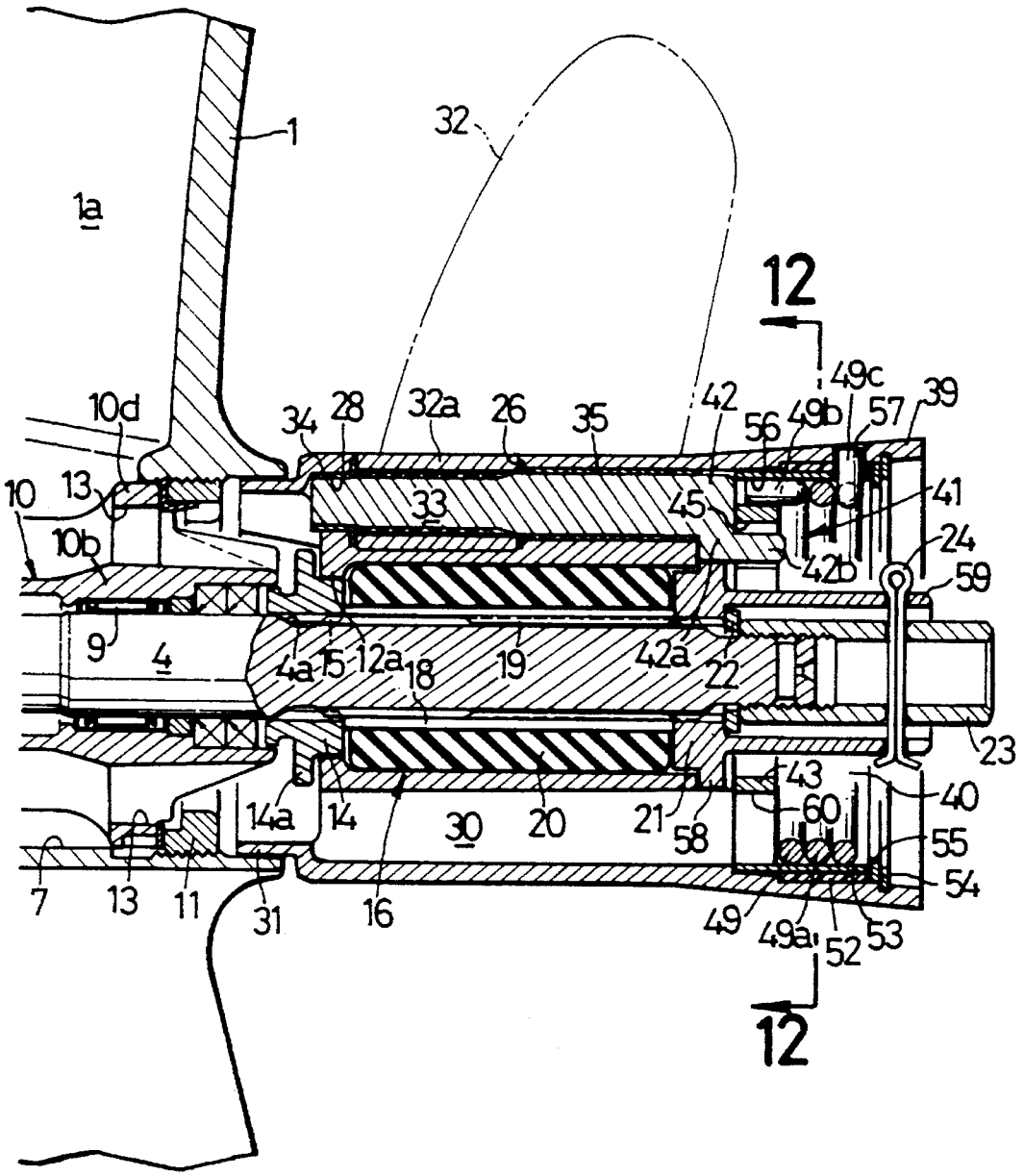
Figure 12:
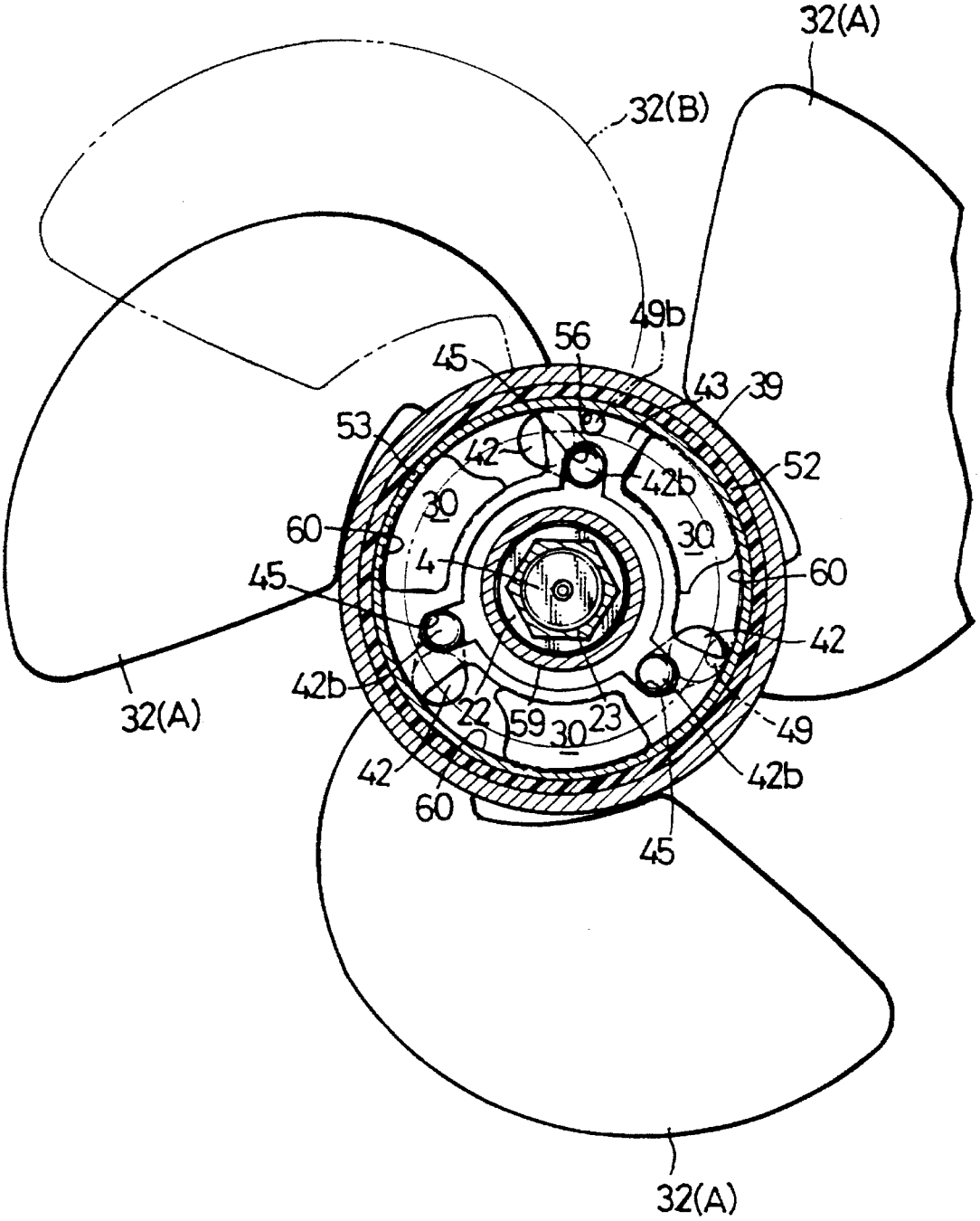
Figure 13:
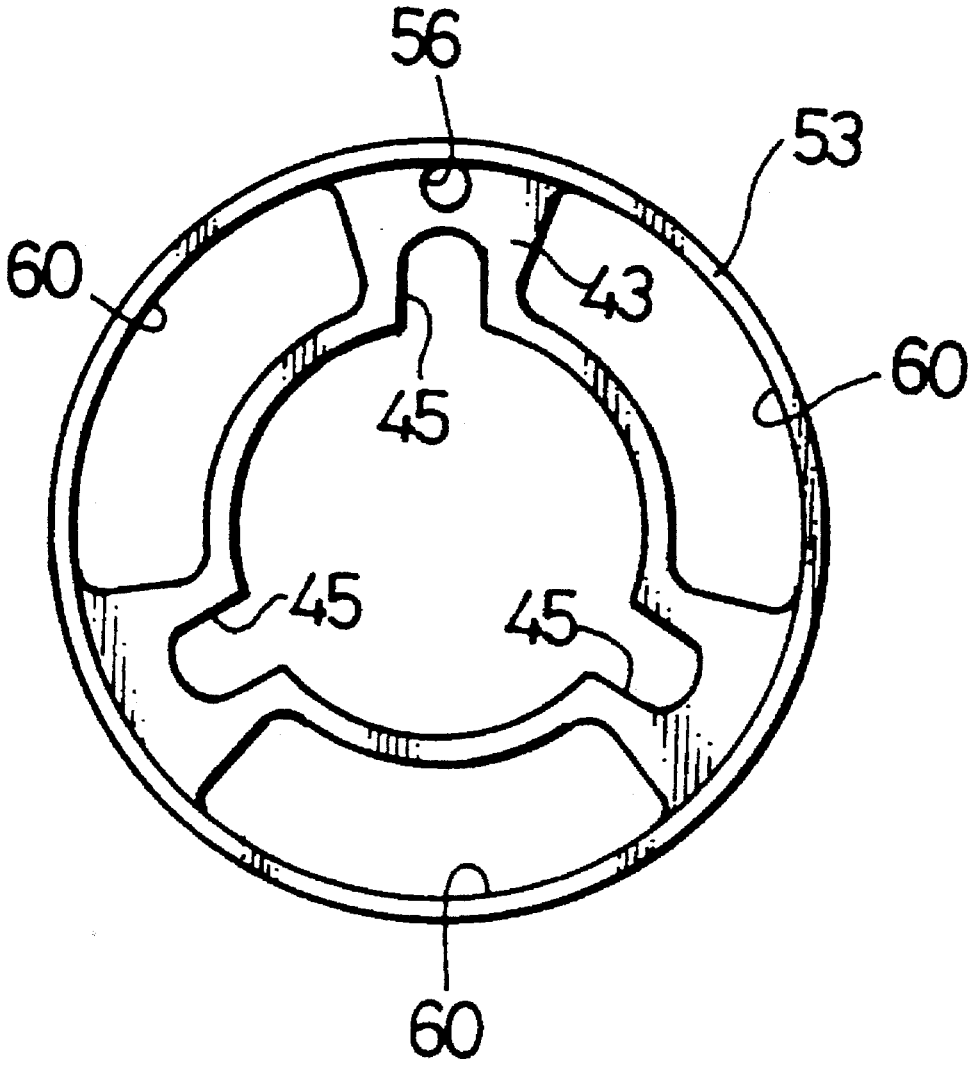

FIGS. 11 to 13 illustrate a fourth embodiment of the present invention. A propeller boss 12 is integrally provided with a diffuser pipe 39. A guide tube 53 projected rearwardly from a circular synchronizing ring 43 is rotatably fitted in an inner peripheral surface of a synthetic resin bush 52 fitted to the inner peripheral surface of the diffuser pipe 39. The rear ends of the bush 52 and guide tube 53 are retained though a washer 55 by a circlip 54 stopped at the inner peripheral surface of the diffuser pipe 39. A coil portion 49*a* of a return spring 49 is disposed along the inner peripheral surface of the guide tube 53, and stopping claws 49*b*, 49*b* at opposite ends thereof are engaged with stopping holes 56 and 59 of the synchronizing ring 43 and the diffuser pipe 39, respectively.

The propeller boss 12 is formed at the front portion thereof with a positioning boss 12*a* rotatably carried on thrust ring 14. On the other hand, an extension color 21 carried on a thrust washer 22 is formed with a flange 58 for receiving a rearward thrust of the propeller boss 12. Further, from the extension collar 21 is projected an extension tube 59 for surrounding a long shaft nut 23 threadedly mounted on the propeller shaft 4. A cotter pin 24 is inserted into the extension tube 59 and the long shaft nut 23.

The circular synchronizing ring 43 is provided with an exhaust hole 60 matched to an exhaust passage 30 of a land portion 27.

Other constructions are substantially the same as those of the first embodiment. In the drawing, therefore, the parts corresponding to those of the first embodiment are indicated by the same reference numerals as those of the first embodiment.

In the above-described respective embodiments, various changes in design can be made without departing the subject matter of the present invention. For example, two or four propeller blades 32 can be used. Further, fixed propeller blades can be provided on the propeller boss 12 along with the variable propeller blades 32.

What is claimed is:

1. A variable propeller for a boat, comprising a propeller shaft supported on a body of a propelling device to project rearwardly of said body and a propeller boss rotatably disposed around said propeller shaft, said propeller shaft being connected to said propeller boss through a torque limiting device which produces a slipping if said device receives a torque equal to or more than a predetermined value, said propeller boss having a plurality of propeller blades displaceably mounted thereon, wherein said torque limiting device and the propeller boss are disposed in concentrically superposed relation about the propeller shaft, the propeller boss is provided with a plurality of recesses whose bottom surfaces are arranged circumferentially in proximity to the torque limiting device, and a boss for each of said propeller blades is rotatably supported, in the recess, by a blade shaft carried by both front and rear end walls of the recesses in parallel to the propeller shaft such that a propeller diameter is variable.

2. A variable propeller for a boat according to claim 1, wherein said propeller boss is provided with an exhaust passage which axially extends through a land portion between the plurality of recesses to open an exhaust outlet of the body of the propelling device into a rear end of the propeller boss.

3. A variable propeller for a boat according to claim 1 or 2, wherein the plurality of blade shafts are connected to the plurality of propeller blades through a synchronizer so as to be rotated along with the propeller blades, said synchronizer comprising a crank continuously formed to one end of each of the blade shafts such that a tip end of a crank arm is directed at the propeller shaft, and a synchronizing ring engaged with crank pins of all the cranks and capable of being rotated around the propeller shaft, said synchronizer being accommodated in a synchronizer chamber formed at one end of the propeller boss.

* * * * *